US007661763B2

(12) United States Patent
Tsai

(10) Patent No.: US 7,661,763 B2
(45) Date of Patent: Feb. 16, 2010

(54) CHAIR ARMREST HAVING A HEIGHT ADJUSTABLE FUNCTION

(76) Inventor: Po-Chuan Tsai, 144, Zhung Zhou, Zhungsheng Cun, Rende Hsiang, Tainan Hsien (TW)

( * ) Notice: Subject to any disclaimer, the term of this patent is extended or adjusted under 35 U.S.C. 154(b) by 95 days.

(21) Appl. No.: 12/017,574

(22) Filed: Jan. 22, 2008

(65) Prior Publication Data

US 2009/0184560 A1 Jul. 23, 2009

(51) Int. Cl.
*A47C 7/54* (2006.01)

(52) U.S. Cl. ..... 297/411.36

(58) Field of Classification Search ..... 297/353, 297/411.36

See application file for complete search history.

(56) References Cited

U.S. PATENT DOCUMENTS 6,824,217 B1 * 11/2004 Wang ..... 297/411.36
6,827,406 B2 * 12/2004 Marini ..... 297/411.36
6,976,739 B2 * 12/2005 Wang ..... 297/411.36
7,011,371 B1 * 3/2006 Tsai ..... 297/411.36 X
7,234,779 B2 * 6/2007 Bedford et al. ..... 297/411.36
7,341,313 B2 * 3/2008 Bedford et al. ..... 297/411.38

* cited by examiner

*Primary Examiner*—Anthony D Barfield
(74) *Attorney, Agent, or Firm*—Alan Kamrath; Kamrath & Associates PA

(57) ABSTRACT

An armrest for a chair includes an armrest support, a sleeve movably mounted on the armrest support, a support arm mounted on the sleeve, a locking member mounted between the armrest support and the sleeve, and a lifting device mounted between the armrest support and the sleeve. Thus, when the control knob of the lifting device is pressed, the movable shaft of the lifting device is unlocked from the locking member so that the movable shaft is movable in the locking member and the support post of the armrest support freely, and the sleeve is movable relative to the support post of the armrest support to adjust the height of the support arm.

15 Claims, 8 Drawing Sheets

CHAIR ARMREST HAVING A HEIGHT ADJUSTABLE FUNCTION

BACKGROUND OF THE INVENTION

1. Field of the Invention

The present invention relates to an armrest and, more particularly, to an armrest for a chair.

2. Description of the Related Art

A conventional lift device for a chair armrest comprises an upright support post, an adjusting pipe movably mounted on the support post and detachably locked on the support post by a locking member, and an armrest support mounted on the upper end of the support post. Thus, when the adjusting pipe is unlocked from the locking member, the adjusting pipe is movable relative to the support post to adjust the height of the armrest support relative to the support post so as to adjust the height of the chair armrest.

BRIEF SUMMARY OF THE INVENTION

In accordance with the present invention, there is provided an armrest for a chair, comprising an armrest support, a sleeve movably mounted on the armrest support, a support arm mounted on the sleeve to move with the sleeve, a locking member mounted between the armrest support and the sleeve, and a lifting device mounted between the armrest support and the sleeve and operable between a first position where the lifting device is locked by the locking member to lock the sleeve onto the armrest support and a second position where the lifting device is unlocked from the locking member to unlock the sleeve from the armrest support so that the sleeve is movable relative to the armrest support freely.

The primary objective of the present invention is to provide a chair armrest having a height adjustable function.

Another objective of the present invention is to provide an armrest for a chair, wherein when the control knob is pressed, the movable shaft is unlocked from the locking member so that the movable shaft is movable in the locking member and the support post of the armrest support freely, and the sleeve is movable relative to the support post of the armrest support to adjust the height of the support arm.

A further objective of the present invention is to provide an armrest for a chair, wherein a user only needs to press the control knob to adjust the height of the support arm so that the height of the support arm is adjusted easily and quickly in an energy-saving manner, thereby facilitating the user adjusting the height of the support arm.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
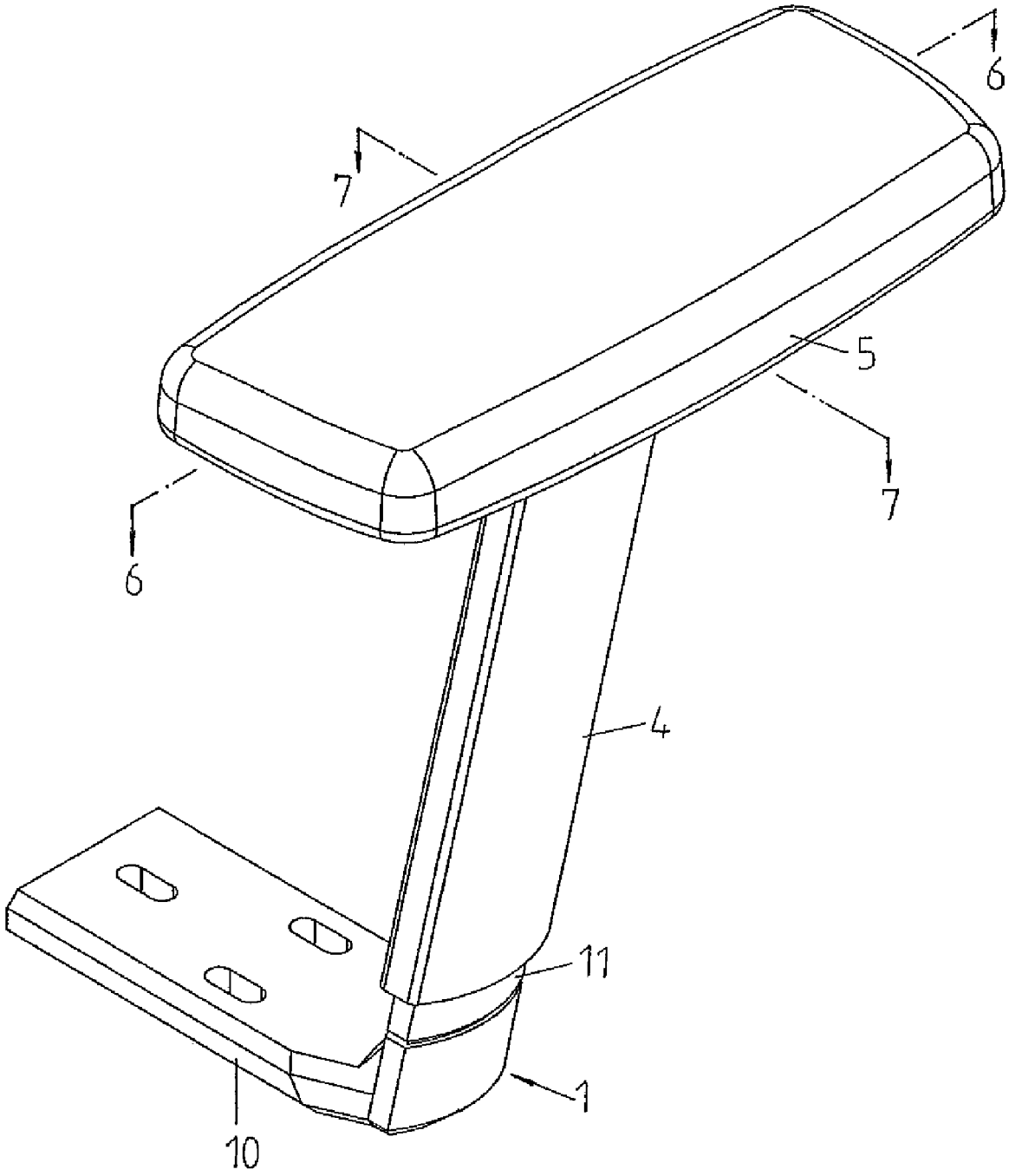
FIG. 1 is a perspective view of an armrest for a chair in accordance with the preferred embodiment of the present invention.
Figure 2:
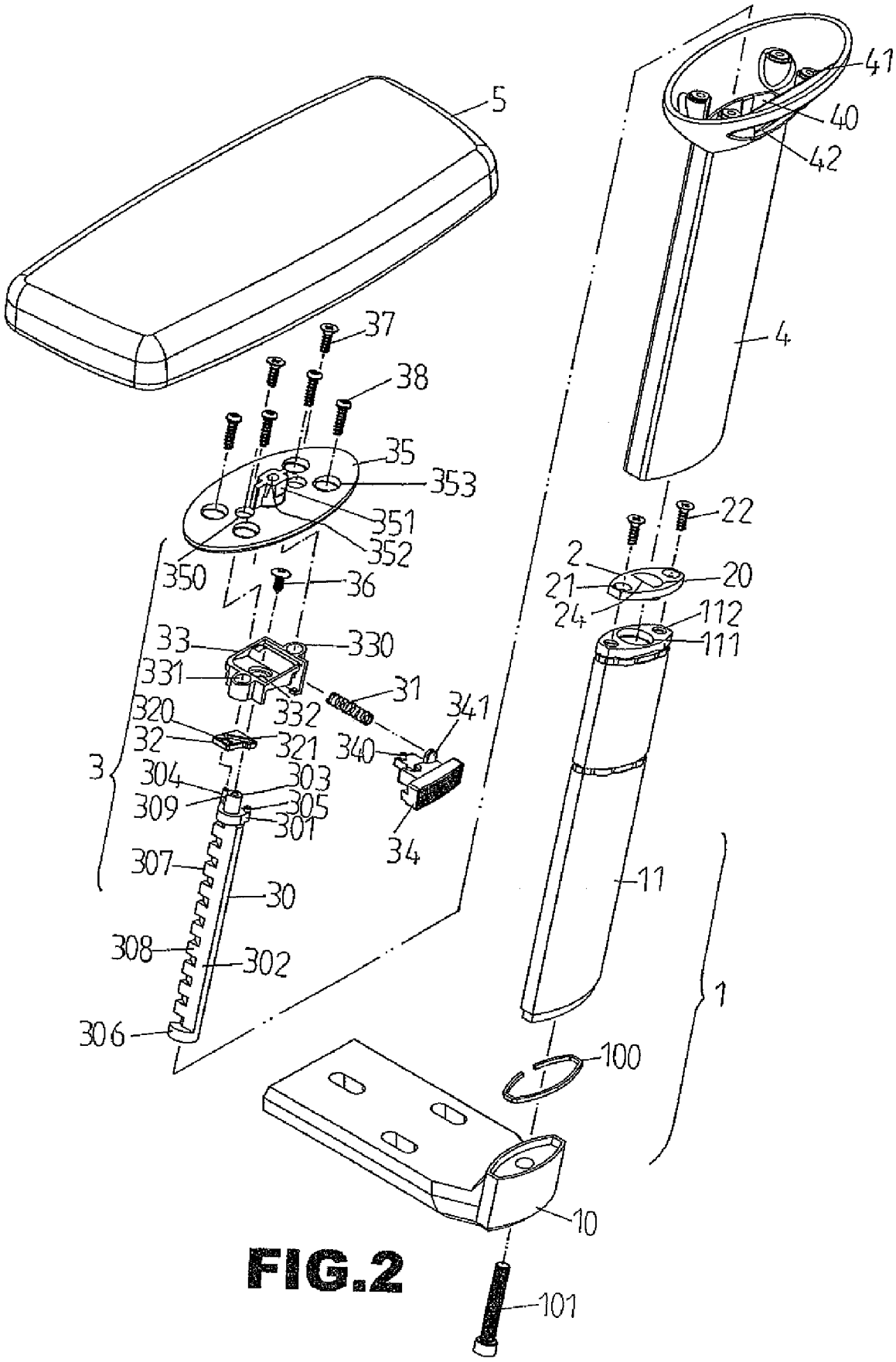
FIG. 2 is an exploded perspective view of the armrest for a chair as shown in FIG. 1.
Figure 3:
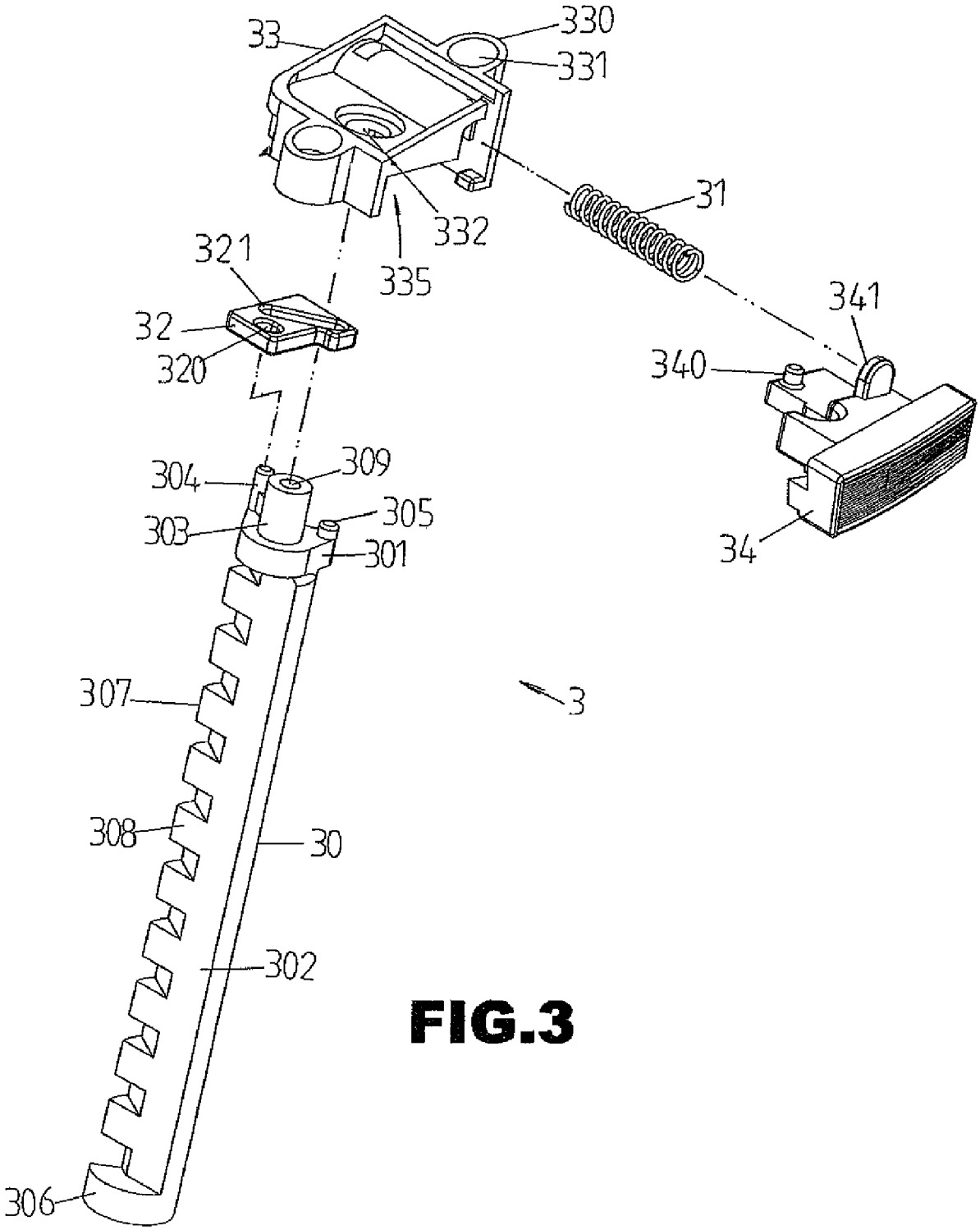
FIG. 3 is a partially exploded perspective view of the armrest for a chair as shown in FIG. 1.
Figure 4:
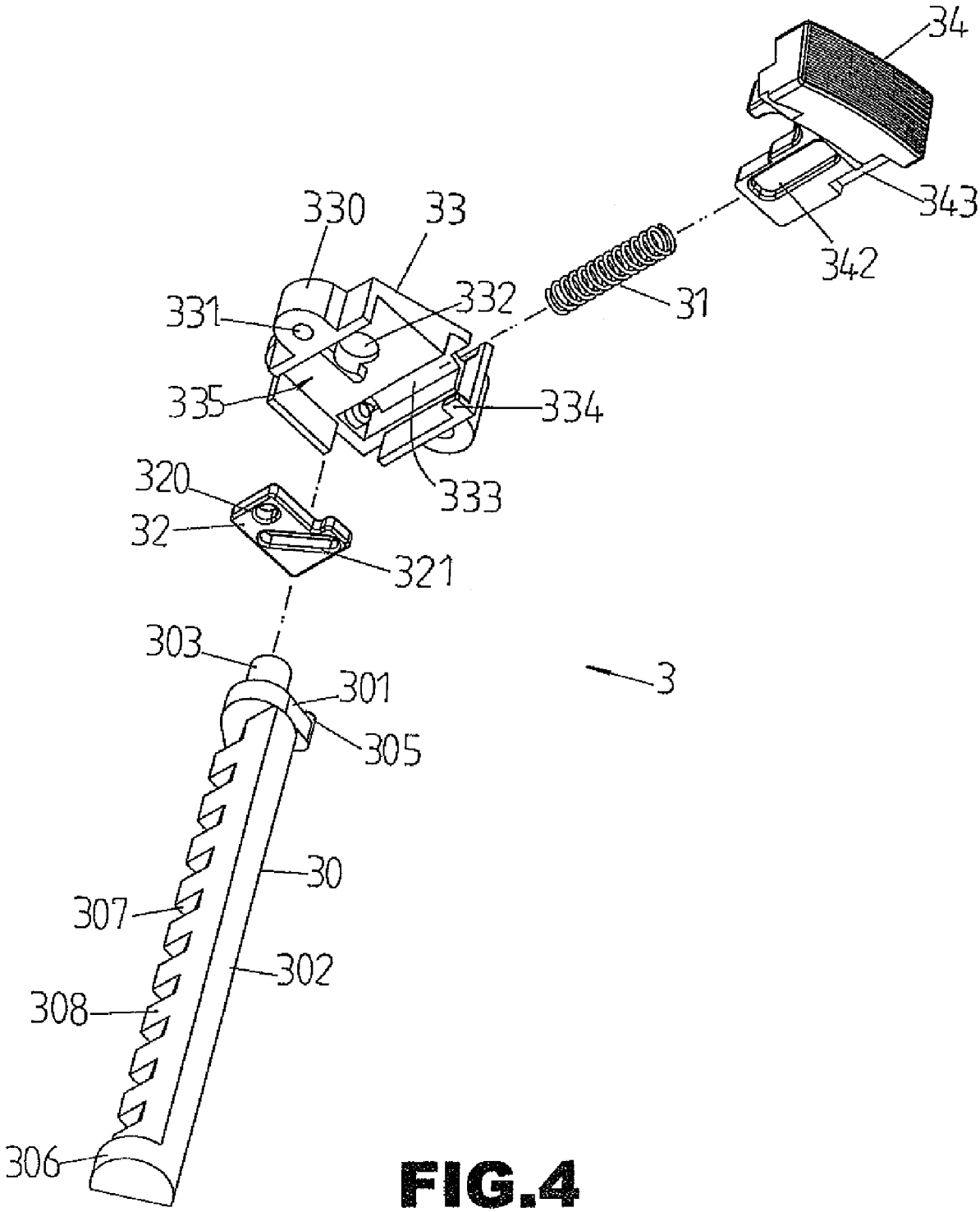
FIG. 4 is a partially exploded perspective view of the armrest for a chair as shown in FIG. 1.

Referring to the drawings and initially to FIGS. 1-7, an armrest for a chair in accordance with the preferred embodiment of the present invention comprises an armrest support 1, a sleeve 4 movably mounted on the armrest support 1, a support arm 5 mounted on the sleeve 4 to move with the sleeve 4, a locking member 2 mounted between the armrest support 1 and the sleeve 4, and a lifting device 3 mounted between the armrest support 1 and the sleeve 4 and operable between a first position where the lifting device 3 is locked by the locking member 2 to lock the sleeve 4 onto the armrest support 1 and a second position where the lifting device 3 is unlocked from the locking member 2 to unlock the sleeve 4 from the armrest support 1 so that the sleeve 4 is movable relative to the armrest support 1 freely.

The armrest support 1 includes a connecting member 10 and an upright support post 11 having a lower end mounted on the connecting member 10 and having an inside provided with a receiving chamber 111 to receive the lifting device 3.

The locking member 2 is mounted on an upper end of the support post 11 of the armrest support 1 and provided with a semi-circular locking hole 20 which has a planar locking side 24.

The lifting device 3 includes a mounting plate 35 mounted on an upper end of-the sleeve 4 to move with the sleeve 4, a positioning member 33 mounted on the mounting plate 35 to move with the mounting plate 35, a movable shaft 30 rotatably mounted on the positioning member 33 and provided with an elongate toothed portion 302 having a plurality of locking teeth 307 that are rotatable with the movable shaft 30 between a first position where each of the locking teeth 307 of the movable shaft 30 aligns with and is locked by the locking side 24 of the locking hole 20 of the locking member 2 to lock the movable shaft 30 onto the locking member 2 and a second position where a planar side 308 of each of the locking teeth 307 aligns with and is unlocked from the locking side 24 of the locking hole 20 of the locking member 2 to unlock the movable shaft 30 from the locking member 2 so that the movable shaft 30 is movable in the support post 11 of the armrest support 1 freely, a slide 32 slidably mounted on the positioning member 33 and connected with the movable shaft 30 to rotate the movable shaft 30 relative to the positioning member 33, a control knob 34 movably mounted on the positioning member 33 and connected with the slide 32 to move the slide 32 relative to the positioning member 33, and an elastic member 31 biased between the control knob 34 and the positioning member 33 to push the control knob 34 outwardly relative to the positioning member 33.

The upper end of the support post 11 of the armrest support 1 is provided with two screw bores 112. The support post 11 of the armrest support 1 is combined with the connecting member 10 by a fixing bolt 101. The armrest support 1 further includes a substantially C-shaped snap ring 100 mounted between the support post 11 and the connecting member 10.

The locking member 2 has a cross-sectional profile corresponding to that of the support post 11 of the armrest support 1. The locking member 2 is received in the sleeve 4 and provided with two through holes 21, and the armrest further comprises two locking screws 22 each extending through a respective through hole 21 of the locking member 2 and each screwed into a respective screw bore 112 of the support post 11 of the armrest support 1 to secure the locking member 2 to the support post 11 of the armrest support 1.

The sleeve 4 is movably mounted on the support post 11 of the armrest support 1 and has an inside provided with a receiving hole 40 mounted on the support post 11 of the armrest support 1. The upper end of the sleeve 4 has a periphery provided with a plurality of screw bores 41 and has a side provided with an elongate slot 42 connected to the receiving hole 40.

The positioning member 33 of the lifting device 3 is provided with two opposite protruding ears 330 each provided with a screw bore 331. The positioning member 33 of the lifting device 3 has an inside provided with a mounting chamber 335 to allow movement of the slide 32 and has a top provided with a through hole 332 connected to the mounting chamber 335. The mounting chamber 335 of the positioning member 33 has a side provided with a mounting space 333 to receive the elastic member 31. The mounting space 333 of the positioning member 33 has a side provided with a protruding limit flange 334.

The slide 32 of the lifting device 3 is substantially L-shaped and provided with an oblique guide slot 321 and a driving hole 320. The slide 32 of the lifting device 3 is slidable in the mounting chamber 335 of the positioning member 33.

The control knob 34 of the lifting device 3 is movable in and partially protrudes outwardly from the elongate slot 42 of the sleeve 4. The control knob 34 of the lifting device 3 has a top provided with a driving rod 340 slidable in the oblique guide slot 321 of the slide 32 to drive the slide 32 to move relative to the positioning member 33 when the control knob 34 is movable relative to the positioning member 33 and has a bottom provided with an elongate limit slot 342. The control knob 34 of the lifting device 3 has a surface provided with a protruding stop flange 341 abutting the elastic member 31 and has a side provided with an elongate limit channel 343 slidable on the limit flange 334 of the positioning member 33.

The movable shaft 30 of the lifting device 3 is movable in the locking hole 20 of the locking member 2 and the receiving chamber 111 of the support post 11. The movable shaft 30 of the lifting device 3 has an upper end provided with a rotation rod 303 rotatably mounted in the through hole 332 of the positioning member 33, a driven rod 304 mounted in and driven by the driving hole 320 of the slide 32 and a limit rod 305 slidable in the limit slot 342 of the control knob 34. The driven rod 304 of the movable shaft 30 is movable relative to the positioning member 33 when the slide 32 is movable relative to the positioning member 33 to drive the movable shaft 30 to rotate relative to the positioning member 33 about the rotation rod 303. The rotation rod 303 of the movable shaft 30 is provided with a screw bore 309, and the armrest further comprises a fastening screw 36 extending through the through hole 332 of the positioning member 33 and screwed into the screw bore 309 of the rotation rod 303 to attach the movable shaft 30 to the positioning member 33. The upper end of the movable shaft 30 is provided with an enlarged top edge 301 that is movable to abut the locking member 2 to stop movement of the movable shaft 30. The movable shaft 30 of the lifting device 3 has a lower end provided with an enlarged bottom edge 306 that is movable to abut the locking side 24 of the locking hole 20 of the locking member 2 to prevent the movable shaft 30 of the lifting device 3 from being detached from the locking member 2 and the support post 11 of the armrest support 1. The toothed portion 302 of the movable shaft 30 is located between the top edge 301 and the bottom edge 306.

The mounting plate 35 of the lifting device 3 is provided with a plurality of through bores 353, and the armrest further comprises a plurality of fixing screws 38 each extending through a respective through bore 353 of the mounting plate 35 and each screwed into a respective screw bore 41 of the sleeve 4 to secure the mounting plate 35 to the sleeve 4. The mounting plate 35 of the lifting device 3 is provided with two through holes 350, and the armrest further comprises two locking screws 37 each extending through a respective through hole 350 of the mounting plate 35 and each screwed into the screw bore 331 of a respective protruding ear 330 of the positioning member 33 to secure the positioning member 33 to the mounting plate 35. The mounting plate 35 of the lifting device 3 has a top provided with a protruding mounting stud 351 which is provided with a screw bore 352 for fixing the support arm 5 to the mounting plate 35.

Figure 5:
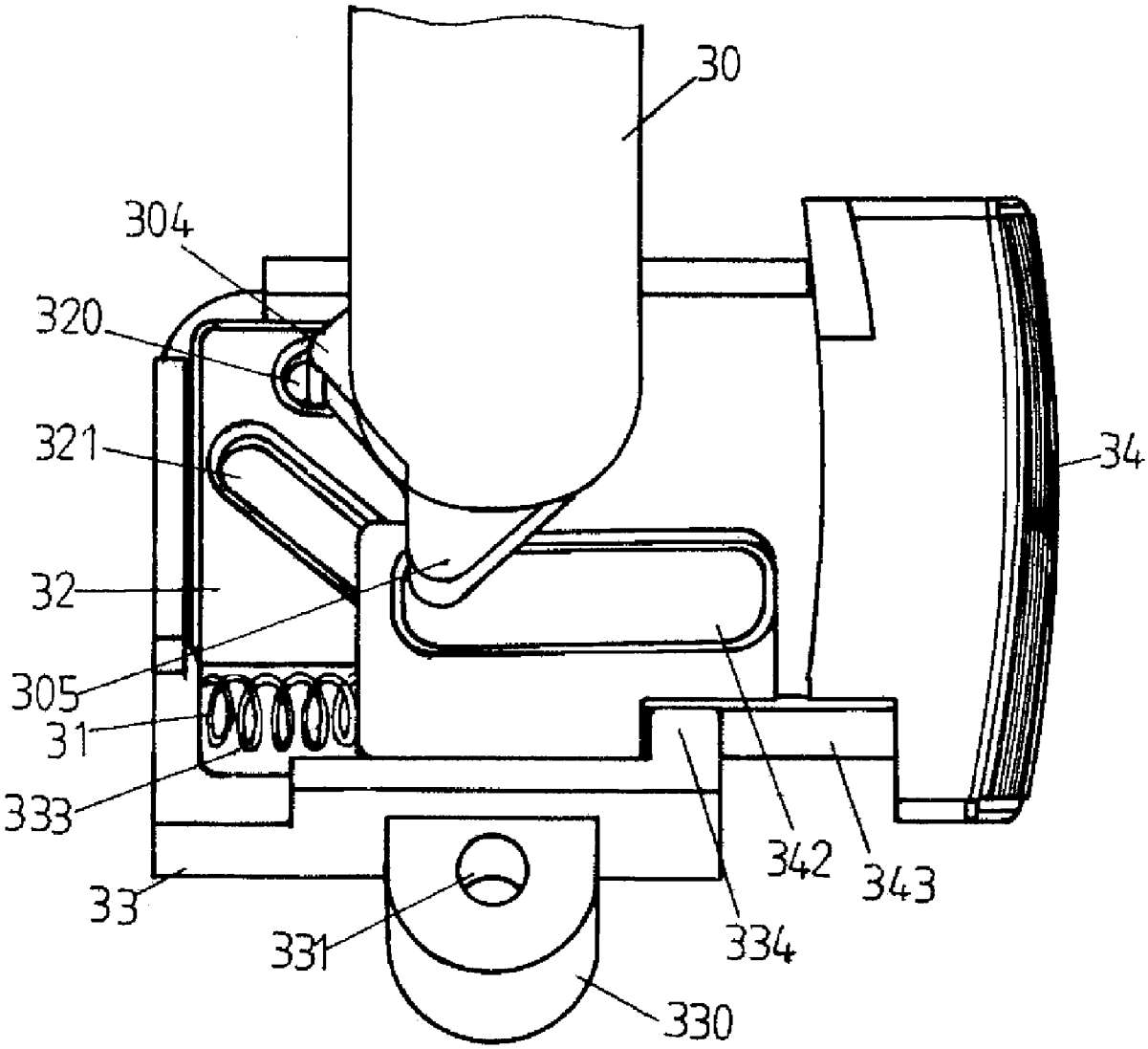
FIG. 5 is a partially bottom view of the armrest for a chair as shown in FIG. 1.
Figure 7:
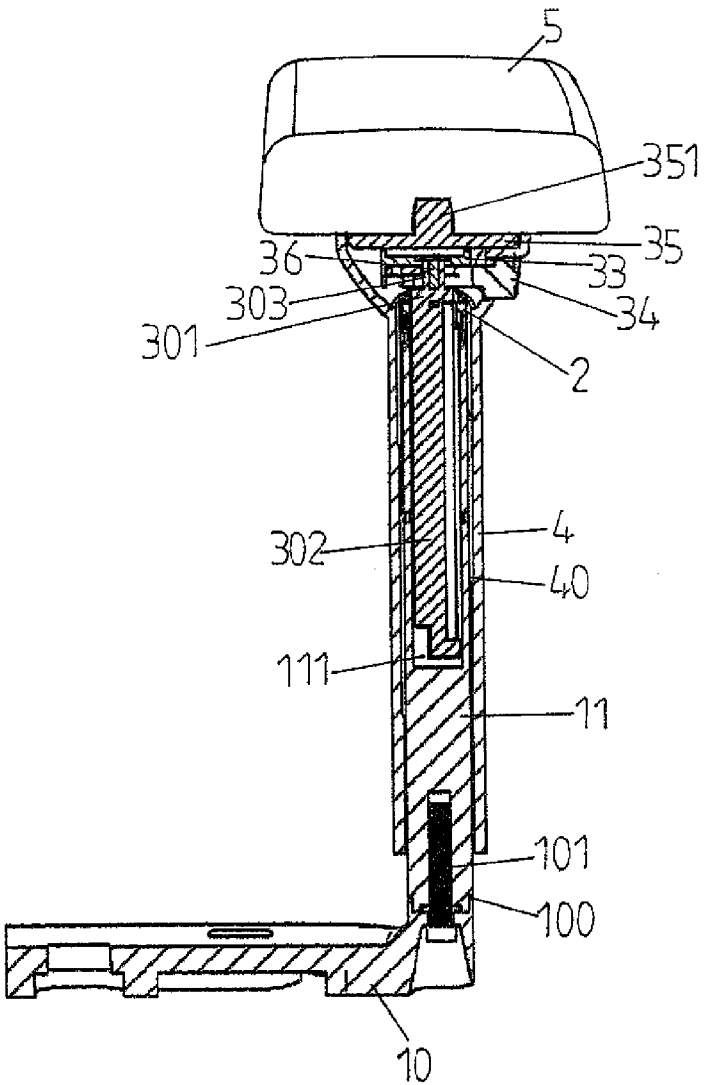
FIG. 7 is a cross-sectional view of the armrest for a chair taken along line 7-7 as shown in FIG. 1.
Figure 6:
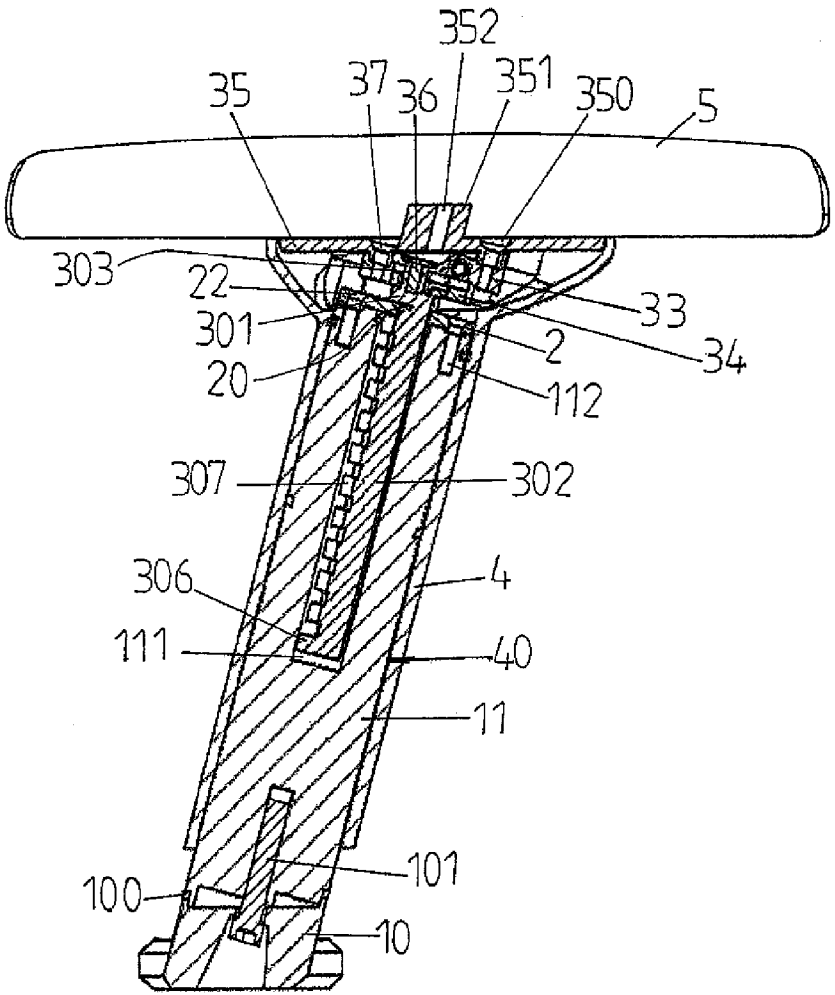
FIG. 6 is a cross-sectional view of the armrest for a chair taken along line 6-6 as shown in FIG. 1.

In operation, referring to FIGS. 5-10 with reference to FIGS. 1-4, when each of the locking teeth 307 of the movable shaft 30 aligns with the locking side 24 of the locking hole 20 of the locking member 2, each of the locking teeth 307 of the movable shaft 30 is locked by the locking side 24 of the locking hole 20 of the locking member 2 to lock the movable shaft 30 onto the locking member 2 as shown in FIGS. 6 and 7, so that the sleeve 4 is fixed on the support post 11 of the armrest support 1.

Figure 8:
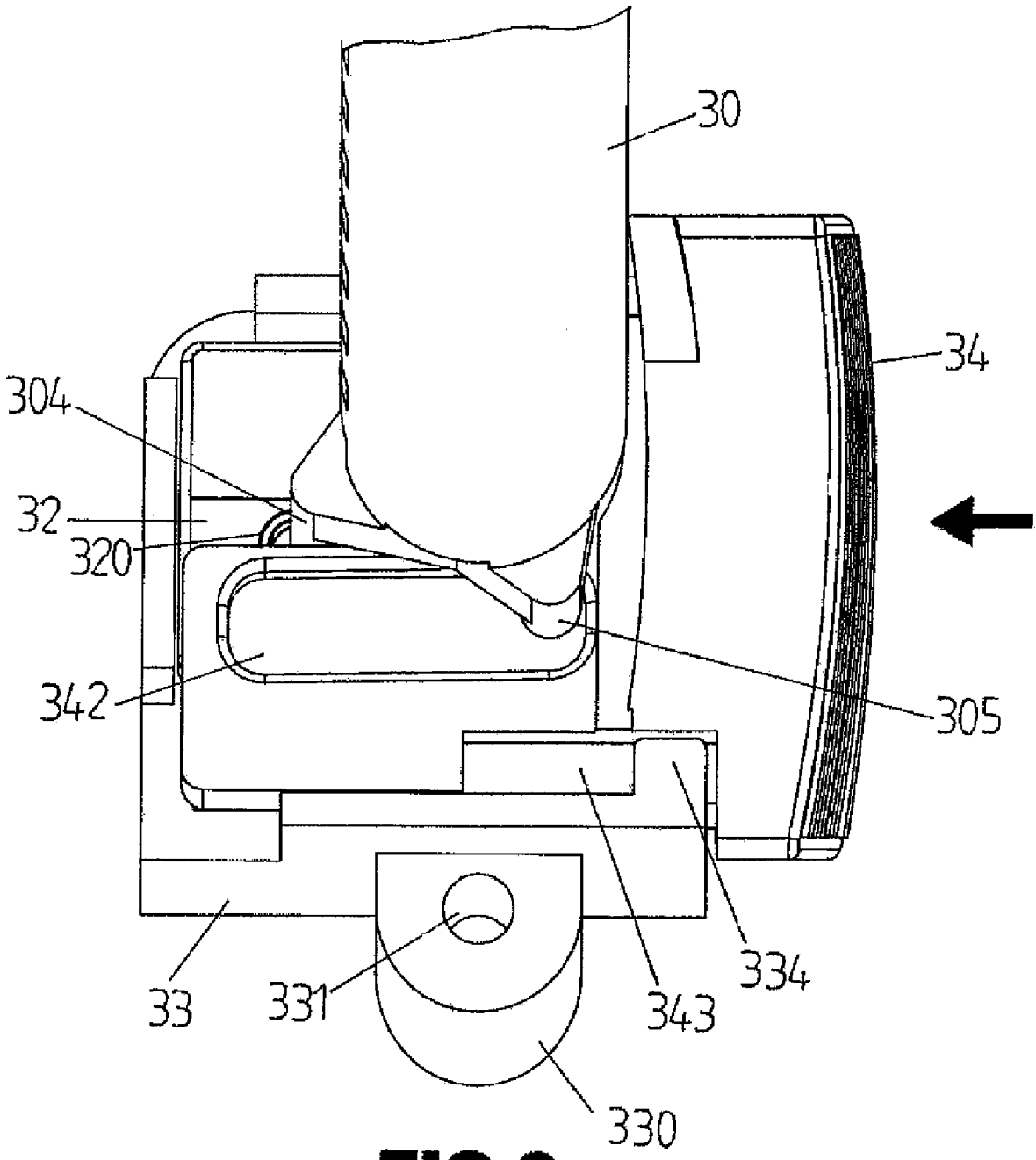
FIG. 8 is a schematic operational view of the armrest for a chair as shown in FIG. 5.

When the control knob 34 is pushed toward the positioning member 33 to compress the elastic member 31 as shown in FIG. 8, the driving rod 340 of the control knob 34 is slidable in the oblique guide slot 321 of the slide 32 to drive the slide 32 to move relative to the positioning member 33 so that the driven rod 304 of the movable shaft 30 is driven by the driving hole 320 of the slide 32 to move relative to the positioning member 33 and to drive the movable shaft 30 to rotate relative to the positioning member 33 about the rotation rod 303. At this time, the limit rod 305 of the movable shaft 30 is slidable in the limit slot 342 of the control knob 34, and the limit channel 343 of the control knob 34 is slidable on the limit flange 334 of the positioning member 33 during rotation of the movable shaft 30 as shown in FIGS. 5 and 8.

Figure 10:
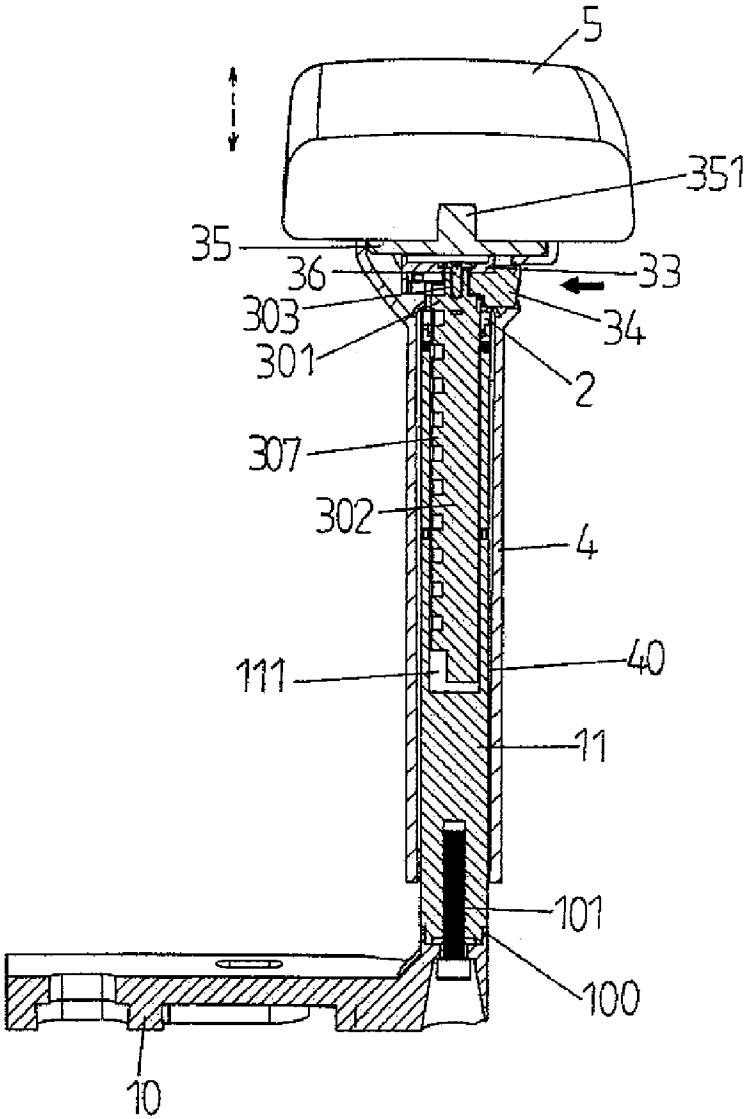
FIG. 10 is a schematic operational view of the armrest for a chair as shown in FIG. 7.
Figure 9:
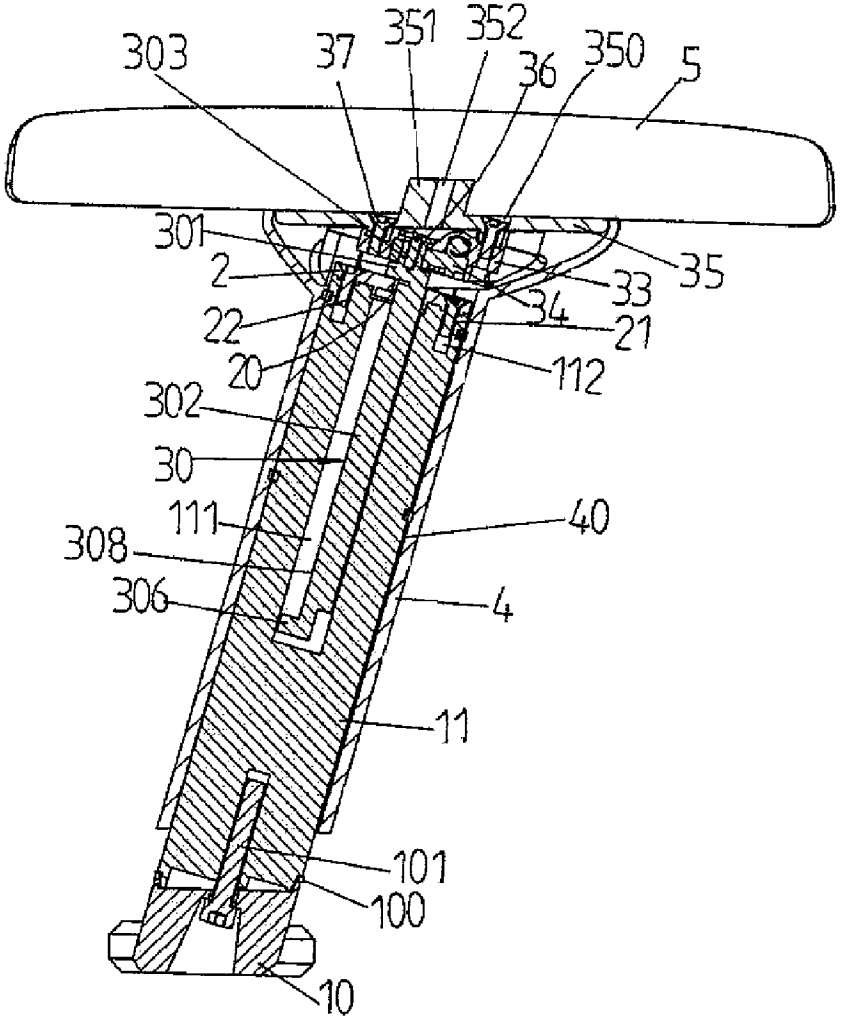
FIG. 9 is a schematic operational view of the armrest for a chair as shown in FIG. 6.

When the movable shaft 30 is rotatable relative to the positioning member 33 to the position as shown in FIGS. 9 and 10, the planar side 308 of each of the locking teeth 307 aligns with the locking side 24 of the locking hole 20 of the locking member 2, so that each of the locking teeth 307 is unlocked from the locking side 24 of the locking hole 20 of the locking member 2 to unlock the movable shaft 30 from the locking member 2 so that the movable shaft 30 is movable in the locking member 2 and the support post 11 of the armrest support 1 freely. In such a manner, the sleeve 4 is movable relative to the support post 11 of the armrest support 1 to adjust the height of the support arm 5.

After the force applied on the control knob 34 disappears, the control knob 34 is pushed outwardly relative to the positioning member 33 by the restoring force of the elastic member 31 as shown in FIG. 5, and the driving rod 340 of the control knob 34 is slidable in the oblique guide slot 321 of the slide 32 to drive the slide 32 to move relative to the positioning member 33 so that the driven rod 304 of the movable shaft 30 is driven by the driving hole 320 of the slide 32 to move relative to the positioning member 33 and to drive the movable shaft 30 to rotate relative to the positioning member 33 about the rotation rod 303.

When the movable shaft 30 is rotatable relative to the positioning member 33 to the position as shown in FIGS. 6 and 7, each of the locking teeth 307 of the movable shaft 30 aligns with and is locked by the locking side 24 of the locking hole 20 of the locking member 2 to lock the movable shaft 30 onto the locking member 2, so that the sleeve 4 is fixed on the support post 11 of the armrest support 1 again.

Accordingly, when the control knob 34 is pressed, the movable shaft 30 is unlocked from the locking member 2 so that the movable shaft 30 is movable in the locking member 2 and the support post 11 of the armrest support 1 freely, and the sleeve 4 is movable relative to the support post 11 of the armrest support 1 to adjust the height of the support arm 5. In addition, a user only needs to press the control knob 34 to adjust the height of the support arm 5 so that the height of the support arm 5 is adjusted easily and quickly in an energy-saving manner, thereby facilitating the user adjusting the height of the support arm 5.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. An armrest for a chair, comprising:

an armrest support;

a sleeve movably mounted on the armrest support;

a support arm mounted on the sleeve to move with the sleeve;

a locking member mounted between the armrest support and the sleeve;

a lifting device mounted between the armrest support and the sleeve and operable between a first position where the lifting device is locked by the locking member to lock the sleeve onto the armrest support and a second position where the lifting device is unlocked from the locking member to unlock the sleeve from the armrest support so that the sleeve is movable relative to the armrest support freely; wherein the armrest support includes a connecting member and an upright support post having a lower end mounted on the connecting member and having an inside provided with a receiving chamber to receive the lifting device;

the locking member is mounted on an upper end of the support post of the armrest support and provided with a semi-circular locking hole which has a planar locking side:

the lifting device includes:

a mounting plate mounted on an upper end of the sleeve to move with the sleeve;

a positioning member mounted on the mounting plate to move with the mounting plate;

a movable shaft rotatably mounted on the positioning member and provided with an elongate toothed portion having a plurality of locking teeth that are rotatable with the movable shaft between a first position where each of the locking teeth of the movable shaft aligns with and is locked by the locking side of the locking hole of the locking member to lock the movable shaft onto the locking member and a second position where a planar side of each of the locking teeth aligns with and is unlocked from the locking side of the locking hole of the locking member to unlock the movable shaft from the locking member so that the movable shaft is movable in the support post of the armrest support freely;

a slide slidably mounted on the positioning member and connected with the movable shaft to rotate the movable shaft relative to the positioning member;

a control knob movably mounted on the positioning member and connected with the slide to move the slide relative to the positioning member;

the slide of the lifting device is provided with an oblique guide slot and a driving hole;

the control knob of the lifting device has a top provided with a driving rod slidable in the oblique guide slot of the slide to drive the slide to move relative to the positioning member when the control knob is movable relative to the positioning member;

the positioning member of the lifting device has a top provided with a through hole;

the movable shaft of the lifting device has an upper end provided with a rotation rod rotatably mounted in the through hole of the positioning member and a driven rod mounted in and driven by the driving hole of the slide.

2. The armrest for a chair in accordance with claim 1, wherein the sleeve is movably mounted on the support post of the armrest support and has an inside provided with a receiving hole mounted on the support post of the armrest support.

3. The armrest for a chair in accordance with claim 2, wherein the upper end of the sleeve has a periphery provided with a plurality of screw bores;

the mounting plate of the lifting device is provided with a plurality of through bores;

the armrest further comprises a plurality of fixing screws each extending through a respective through bore of the mounting plate and each screwed into a respective screw bore of the sleeve to secure the mounting plate to the sleeve.

4. The armrest for a chair in accordance with claim 2, wherein the upper end of the sleeve has a side provided with an elongate slot connected to the receiving hole;

the control knob of the lifting device is movable in and partially protrudes outwardly from the elongate slot of the sleeve.

5. The armrest for a chair in accordance with claim 1, wherein the positioning member of the lifting device is provided with two opposite protruding ears each provided with a screw bore;

the mounting plate of the lifting device is provided with two through holes;

the armrest further comprises two locking screws each extending through a respective through hole of the mounting plate and each screwed into the screw bore of a respective protruding ear of the positioning member to secure the positioning member to the mounting plate.

6. The armrest for a chair in accordance with claim 1, wherein the control knob of the lifting device has a bottom provided with an elongate limit slot;

the upper end of the movable shaft is further provided with a limit rod slidable in the limit slot of the control knob during rotation of the movable shaft.

7. The armrest for a chair in accordance with claim 1, wherein the movable shaft of the lifting device is movable in the locking hole of the locking member and the receiving chamber of the support post.

8. The armrest for a chair in accordance with claim 1, wherein the rotation rod of the movable shaft is provided with a screw bore;

the armrest further comprises a fastening screw extending through the through hole of the positioning member and screwed into the screw bore of the rotation rod to attach the movable shaft to the positioning member.

9. The armrest for a chair in accordance with claim 1, wherein the upper end of the movable shaft is provided with an enlarged top edge that is movable to abut the locking member to stop movement of the movable shaft;

the movable shaft of the lifting device has a lower end provided with an enlarged bottom edge that is movable to abut the locking side of the locking hole of the locking member to prevent the movable shaft of the lifting device from being detached from the locking member and the support post of the armrest support.

10. The armrest for a chair in accordance with claim 9, wherein the toothed portion of the movable shaft is located between the top edge and the bottom edge.

11. The armrest for a chair in accordance with claim 1, wherein the upper end of the support post of the armrest support is provided with two screw bores;

the locking member has a cross-sectional profile corresponding to that of the support post of the armrest support;

the locking member is received in the sleeve and provided with two through holes;

the armrest further comprises two locking screws each extending through a respective through hole of the locking member and each screwed into a respective screw bore of the support post of the armrest support to secure the locking member to the support post of the armrest support.

12. The armrest for a chair in accordance with claim 1, wherein the slide of the lifting device is substantially L-shaped;

the armrest support further includes a substantially C-shaped snap ring mounted between the upright support post and the connecting member.

13. The armrest for a chair in accordance with claim 1, wherein the mounting plate of the lifting device has a top provided with a protruding mounting stud which is provided with a screw bore for fixing the support arm to the mounting plate.

14. The armrest for a chair in accordance with claim 1, wherein the driven rod of the movable shaft is movable relative to the positioning member when the slide is movable relative to the positioning member to drive the movable shaft to rotate relative to the positioning member about the rotation rod.

15. An armrest for a chair, comprising:

an armrest support;

a sleeve movably mounted on the armrest support;

a support arm mounted on the sleeve to move with the sleeve;

a locking member mounted between the armrest support and the sleeve;

a lifting device mounted between the armrest support and the sleeve and operable between a first position where the lifting device is locked by the locking member to lock the sleeve onto the armrest support and a second position where the lifting device is unlocked from the locking member to unlock the sleeve from the armrest support so that the sleeve is movable relative to the armrest support freely; wherein the armrest support includes a connecting member and an upright support post having a lower end mounted on the connecting member and having an inside provided with a receiving chamber to receive the lifting device;

the locking member is mounted on an upper end of the support post of the armrest support and provided with a semi-circular locking hole which has a planar locking side;

the lifting device includes;

a mounting plate mounted on an upper end of the sleeve to move with the sleeve a positioning member mounted on the mounting plate to move with the mounting plate;

a movable shaft rotatably mounted on the positioning member and provided with an elongate toothed portion having a plurality of locking teeth that are rotatable with the movable shaft between a first position where each of the locking teeth of the movable shaft aligns with and is locked by the locking side of the locking hole of the locking member to lock the movable shaft onto the locking member and a second position where a planar side of each of the locking teeth aligns with and is unlocked from the locking side of the locking hole of the locking member to unlock the movable shaft from the locking member so that the movable shaft is movable in the support post of the armrest support freely;

a slide slidably mounted on the positioning member and connected with the movable shaft to rotate the movable shaft relative to the positioning member;

a control knob movably mounted on the positioning member and connected with the slide to move the slide relative to the positioning member;

an elastic member biased between the control knob and the positioning member to push the control knob outwardly relative to the positioning member;

the positioning member of the lifting device has an inside provided with a mounting chamber to allow movement of the slide;

the slide of the lifting device is slidable in the mounting chamber of the positioning member;

the mounting chamber of the positioning member has a side provided with a mounting space to receive the elastic member;

the mounting space of the positioning member has a side provided with a protruding limit flange;

the control knob of the lifting device has a surface provided with a protruding stop flange abutting the elastic member and has a side provided with an elongate limit channel slidable on the limit flange of the positioning member during rotation of the movable shaft.

* * * * *